US005954928A

United States Patent [19]

Kishi et al.

[11] Patent Number: 5,954,928

[45] Date of Patent: Sep. 21, 1999

[54] ACTIVATED CATHODE AND METHOD FOR MANUFACTURING THE SAME

[75] Inventors: Takamichi Kishi; Osamu Arimoto, both of Okayama, Japan

[73] Assignee: Chlorine Engineers Corp., Ltd., Japan

[21] Appl. No.: 08/634,355

[22] Filed: Apr. 18, 1996

[30] Foreign Application Priority Data

Apr. 26, 1995 [JP] Japan ..... 7-125911

[51] Int. Cl.[6] ..... C25B 11/00

[52] U.S. Cl. ..... 204/290 R; 204/290 F; 429/40; 429/44; 429/45

[58] Field of Search ..... 204/290 R, 290 F; 429/40, 44, 45

[56] References Cited

U.S. PATENT DOCUMENTS

| | | | |
|---|---|---|---|
| 4,377,454 | 3/1983 | Bommaraju et al. | 204/290 F |
| 4,487,818 | 12/1984 | Ovshinsky et al. | 204/293 |
| 4,555,317 | 11/1985 | Nicolas et al. | 204/290 R |
| 4,587,001 | 5/1986 | Cairns et al. | 204/290 R |
| 4,871,703 | 10/1989 | Beaver et al. | 204/290 R |
| 4,900,585 | 2/1990 | Leroux et al. | 204/290 R |
| 4,970,094 | 11/1990 | Byrd | 204/290 R |

FOREIGN PATENT DOCUMENTS

| | | |
|---|---|---|
| 2284690 | 9/1975 | France . |
| 3612790 | 10/1987 | Germany . |
| 61-12032 | of 1986 | Japan . |
| 61-36590 | of 1986 | Japan . |
| 63-64518 | of 1988 | Japan . |
| 3-35387 | of 1991 | Japan . |
| 5-27712 | of 1993 | Japan . |

OTHER PUBLICATIONS

Platinum Metals Review, vol. 29, pp. 98–106 1985 No month available.

Grove, D.E., "Precious–Metal Activated Cathodes for Chloralkali Cells", in Modern Chlor–Alkali Technology, vol. 3, Chapter 19, 1986 No month available.

*Primary Examiner*—Bruce F. Bell
*Attorney, Agent, or Firm*—Lorusso & Loud

[57] ABSTRACT

In an activated cathode and a method for manufacturing the activated cathode, a first layer which contains nickel or cobalt as a main component is formed on a metal substrate, and a second layer which contains platinum or ruthenium as a main component is formed on the first layer. It is preferable that the first layer is formed of Raney nickel and the second layer has a large cathode working area, or it is also preferable that the first layer is formed of nickel oxide or cobalt oxide, and the second layer is formed of fine platinum or ruthenium particles and has a large cathode working area.

4 Claims, No Drawings

ACTIVATED CATHODE AND METHOD FOR MANUFACTURING THE SAME

BACKGROUND OF THE INVENTION

1. Field of the Invention

The present invention relates to an activated cathode and a method for manufacturing the activated cathode, and more particularly to an activated cathode which is capable of electrolyzing solution of alkali metal salt such as alkali-metal halide, alkali-metal hydroxide or the like with a low hydrogen overvoltage for a long term.

2. Description of Related Art

Materials which contain soft iron as a main component have been hitherto used for cathodes in an electrolysis process for electrolyzing alkali-metal halide solution or alkali-metal hydroxide solution by using a diaphragm method, an ion-exchange membrane method or the like. In this electrolysis process, hydrogen is generated on the cathodes. Soft iron has a disadvantage that its hydrogen overvoltage is high. Therefore, there has been proposed various types of activated cathodes each having a hydrogen overvoltage lower than that of a cathode which contains soft iron as a main component. Each of these proposed activated cathodes is formed of a metal substrate of soft iron or the like which is coated with a material formed of metal element of nickel, cobalt, platinum or groups thereof, a mixture thereof, or oxides thereof. An electroplating method, an electroless plating method, a dispersive electroplating method, a thermal spraying method, an immersing method or the like has been proposed as a method of forming the above metal coating on the metal substrate. For example, there have been proposed an activated cathode on which Raney nickel element is plated or a composite of Raney nickel and hydrogen occluding (storage) material is plated (as disclosed in Japanese Post-examined Patent Application Nos. Sho-61-12032 and Sho-61-36590), and an activated cathode on which nickel oxide or cobalt oxide is thermally sprayed (as disclosed in Japanese Post-examined Patent Application Nos. Sho-63-64518 and Hei-3-35387).

The following features are the most important factors for the activated cathodes. It is needless to say that the overvoltage can be kept to a small value, and no deterioration occurs in the activated cathodes when an electrolytic cell is stopped or dismantled. In addition, when the activated cathodes are used with zero gap in an ion-exchange membrane type electrolytic cell, the ion-exchange membrane is not contaminated with a coating material such as nickel or the like, and a manufacturing cost is low.

In the above proposed methods to achieve a low hydrogen overvoltage as described above, for example, the activated cathode on which Raney nickel element is plated or a composite of Raney nickel and hydrogen occluding material is plated can keep a low hydrogen overvoltage, however, this type of activated cathode has disadvantages that the ion-exchange membrane is contaminated with nickel and that when an electrolytic cell is dismantled, the activated cathode is brought into contact with air to be oxidized, so that ignition (spontaneous combustion) occurs in the activated cathode or the activated cathode is deteriorated. On the other hand, in the case of the activated cathode on which nickel oxide or cobalt oxide is thermally sprayed, it is not oxidized and deteriorated even when it is brought into contact with air. However, the latter type activated cathode (thermally sprayed with nickel oxide or cobalt oxide) has a higher hydrogen overvoltage than that of the activated cathode (plated with Raney nickel element or the like), and the hydrogen overvoltage increases with time lapse.

In addition to the above types activated cathodes, an activated cathode having a coating film which is formed of metals of platinum group is also proposed as an activated cathode having a low hydrogen overvoltage. However, this activated cathode has a disadvantage that adhesion of the platinum group metal such as platinum, ruthenium or the like to a metal substrate is weak and thus it is liable to be exfoliated from the metal substrate because the platinum group metal is merely coated on the surface of the smooth metal substrate. In addition, a large amount of platinum group metal is needed to further enhance surface activity, and thus this induces an economical problem. In view of the foregoing problems, no sufficient consideration has been hitherto made on the activation cathode which contains platinum group metal as a main component.

SUMMARY OF THE INVENTION

In view of the present situation of the conventional activated cathodes as described above, the present invention has an object to provide an activated cathode which induces no contamination to an ion-exchange film, has no deterioration and no risk of ignition, and can keep a sufficiently low hydrogen voltage, and a method of manufacturing the activated cathode.

Another object of the present invention is to provide an activated cathode which can keep the advantages of the conventional activated cathodes and overcome the disadvantages thereof. That is, with respect to the activated cathode on which Raney nickel element is plated or a composite of Raney nickel and hydrogen occluding material (alloy) is plated, the contamination of the ion-exchange membrane with nickel can be prevented. In addition, even when an electrolytic cell is dismantled, the oxidation of the activated cathode can be prevented, and the ignition of the activated cathode can be also prevented. Further, with respect to the activated cathode on which nickel oxide or cobalt oxide is thermally sprayed, the hydrogen overvoltage can be reduced.

In order to attain the above objects, according to an aspect of the present invention, an activated cathode is characterized by comprising a metal substrate, a first layer which is formed on the metal substrate and contains nickel or cobalt as a main component, and a second layer which contains platinum or ruthenium as a main component (hereinafter referred to as "platinum-based second layer" or "ruthenium-based second layer") and formed on the first layer.

In the activated cathode thus constructed, the first layer preferably contains Raney nickel, and the second layer preferably has a large cathode working area. Further, the first layer preferably contains nickel oxide or cobalt oxide, and the second layer is preferably formed of platinum particles or ruthenium particles and has a large cathode working area. The grain size of these platinum particles or ruthenium particles is preferably set to 0.001 to 0.01 $\mu$m. The cathode effective area preferably ranges from 30 to 3000 times with respect to a projected area of 1 $m^2$ of the cathode.

According to another aspect of the present invention, a method for manufacturing an activated cathode is characterized by comprising the steps of: forming on a metal substrate a first film which contains metal nickel as a main component to form a cathode substrate, and immersing the cathode substrate in solution of platinum salt or ruthenium salt to coat the first layer with a second layer which contains platinum or ruthenium as a main component.

Furthermore, according to another aspect of the present invention, a method for manufacturing an activated cathode is characterized by comprising the steps of: forming on a metal substrate a first film which contains nickel or cobalt as a main component to form a cathode substrate, immersing the cathode substrate in solution of platinum salt or ruthenium salt, and electrolyzing the cathode substrate to coat the first layer with a second layer which contains platinum or ruthenium as a main component.

In the manufacturing methods as described above, the first layer is preferably formed by an electroplating method, an electroless plating method, a dispersive electroplating method, a thermally spraying method, or an immersing method.

In the present invention, the "cathode working area" is different from the apparent area (projected area) of the cathode, and it means the surface area of a part which can work substantially as a cathode.

According to the activated cathode of the present invention, the first layer which contains nickel or cobalt (such as Raney nickel or cobalt oxide) as a main component (hereinafter referred to as "nickel-based or cobalt-based first layer") is formed on the metal substrate, and then the surface of the first layer is coated with the chemically-stable platinum-based or ruthenium-based second layer (preferably platinum particles or ruthenium particles). Therefore, the activated cathode can be designed to have a large cathode working area and a low hydrogen overvoltage. Furthermore, the surface of the cathode which contains of Raney nickel or the like as a main component and has a large surface area is coated with the chemically-stable second layer, the contamination of an ion-exchange membrane with nickel can be prevented. Even when an electrolytic cell is stopped to work or dismantled, the nickel-based cathode surface having high reaction activity can be prevented from coming into contact with air to thereby prevent the deterioration of the cathode.

According to the activated cathode of the present invention, the first layer of nickel oxide or cobalt oxide, whose surface is in a low-activity state, has a relatively large hydrogen overvoltage, however, the surface of the first layer is coated with the fine platinum particles or ruthenium particles which have hydrogen occluding properties and are highly active, so that the hydrogen overvoltage can be reduced.

According to the activated cathode of the present invention, even when a so-called backward current flows through the cathode when electrolysis is stopped to cause the cathode to be positively polarized, the platinum is not easily oxidized. On the other hand, although ruthenium is oxidized, oxidized ruthenium is easily reduced to ruthenium by resupplying current. Therefore, these materials suffer no loss in activity and are kept stable. In addition, both platinum and ruthenium are more excellent in chemical durability than nickel, and thus the ion-exchange membrane can be prevented from being contaminated with nickel by coating platinum or ruthenium on the nickel-based first layer.

Furthermore, according to the activated cathode of the present invention, the first layer is formed on the metal substrate by using a conventional method selected from the electroplating method, the dispersive plating method, etc., and then it is immersed in solution of platinum salt or ruthenium salt (and then subjected to an electrolysis process if necessary) to form the second layer having a large cathode working area. Accordingly, an activated cathode having a more stable and lower hydrogen overvoltage can be obtained by using a conventional activated cathode.

DETAILED DESCRIPTION OF THE INVENTION

The present invention is explained hereunder in detail. The material of the metal substrate used in the present invention is not limited to a specific material, and ordinarily stainless steel, nickel, cobalt, iron and steel or the like may be used for the metal substrate. Further, the structure of the metal substrate is not limited to a specific one, and a planar type, an expanded metal type, a perforated planar type, a mesh type, a rod type or the like may be used for the metal substrate. The first layer of the present invention is a nickel-based or cobalt-based layer formed on the metal substrate as described above, and it is formed in the same manner as used for the conventional activated cathodes. As the nickel-based first layer may be used a Raney nickel layer, a composite layer of Raney nickel and hydrogen occluding material (alloy), a nickel alloy layer such as an alloy layer of nickel and tin, an alloy layer of nickel and chromium or the like, a nickel layer containing other components such as a sulfur-contained nickel layer, a nickel layer containing activated charcoal and sulfur or the like, and the same surface layer as used for the conventional nickel-based activated cathode, for example, a nickel oxide layer or the like. The surface layer which is formed of Raney nickel or a composite of Raney nickel and hydrogen occluding material is preferably used because it has a large surface area and high activity.

As the cobalt-based first layer may be used the surface layer of the conventional activated cathode which is formed of cobalt oxide.

The first layer as described above may be formed by a normal electroplating method, a electroless plating method, a dispersive electroplating method, a thermal spraying method or an immersing method, and one of these methods may be suitably selected in accordance with the component of the first layer. Further, the thickness of the first layer is preferably set to a range from 10 to 500 $\mu$m, and it is suitably selected. Usually, the thickness is set to 50 to 300 $\mu$m.

The second layer of the activated cathode according to the present invention is formed of platinum group metal such as platinum or ruthenium, and it is coated on the surface of the first layer. The second layer of the present invention is formed as follows. That is, a conventional activated cathode having the first layer as described above formed on a metal substrate is immersed in solution of platinum salt or ruthenium salt as described later, or immersed in the platinum salt solution or ruthenium salt solution and then electrolyzed. In the present invention, the surface of the nickel-based first layer is coated with the second layer which is formed of platinum or ruthenium, and thus an ion-exchange membrane can be prevented from being contaminated with nickel because platinum and ruthenium have higher chemical durability than nickel.

The second layer of the activated cathode of the present invention preferably has a large cathode working area, and thus it is designed to have a large surface area. The large cathode working area means a surface area which acts substantially as a cathode, and it is preferable that the cathode working area has a large surface area of about 30 to 3000 times with respect to an apparent unit area of the activated cathode, that is, 1 $m^2$ projection area of the cathode. The activated cathode of the present invention is designed to have a large surface area, so that the cathode working area is increased. Accordingly, the substantial cathode current density is reduced, resulting in reduction of the hydrogen overvoltage.

A method of designing the second layer to have a large surface area is suitably selected in accordance with the type of the first layer below the second layer. For example, when the first layer is formed of oxide material such as nickel oxide or cobalt oxide, fine platinum or ruthenium particles having a grain size ranging from 0.001 to 0.01 $\mu$m are coated on the first layer in water solution in which platinum salt or ruthenium salt is solved, by using an electrolysis method or the like. Further, when the first layer is formed of a Raney-nickel contained layer such as a layer of Raney nickel, a layer containing Raney nickel and hydrogen occluding material (alloy) or the like, the first layer itself has a large surface area. Therefore, the first layer is subjected to the electrolysis treatment while immersed in water solution in which platinum salt or ruthenium salt is solved, thereby forming a platinum or ruthenium coating as the second layer on the surface of the first layer. In this case, the second layer is naturally designed to have a large surface.

According to the activated cathode of the present invention, the nickel-based or cobalt-based first layer and the platinum or ruthenium second layer are successively formed in this order on the metal substrate as described above. Therefore, the surface of the conventional activated cathode, that is, the first layer is coated with the second layer of platinum group metal such as platinum or ruthenium. Accordingly, the surface of the cathode is replaced by the platinum or ruthenium layer which is highly active and stable, so that the hydrogen overvoltage is reduced.

Furthermore, according to the activated cathode of the present invention, it has been confirmed that the resistance of the activated cathode to the backward current is enhanced and the activity is not degraded. The cause for the above effects is not clear, however, it is presumed that platinum or ruthenium occludes a lot of hydrogen under operation and thus the occluded hydrogen is oxidized when the backward current flows, whereby the highly active surface portion can be suppressed from being deteriorated. In addition, platinum or ruthenium are excellent in chemical stability. For example, platinum is not easily oxidized even under an oxidation atmosphere. Even when ruthenium is partially oxidized, oxidized ruthenium can be easily reduced to ruthenium and activated by re-supplying current. Therefore, the activated cathode of the present invention keeps a low hydrogen overvoltage while keeping its activity stable.

Further, the above features of the platinum or ruthenium second layer are not dependent on the shape or components of the first layer. The above phenomenons have not been hitherto known, and the inventors of this application is the first persons to discover the phenomenons.

According to the active cathode of the present invention, a nickel-based or cobalt-based coating (layer) on the metal substrate, which is formed in the same manner as the conventional activated cathode is used as the first layer, and the second layer which is formed of platinum or ruthenium is formed as a coating on the first layer as described above. The second layer of the present invention may be formed by immersing the conventional activated cathode in water solution of platinum salt or ruthenium salt, or by performing the electrolysis process after the above immersing process.

When the first layer on the metal substrate is a nickel-based layer, the cathode substrate having the first layer thereon is immersed in the water solution of platinum salt or ruthenium salt, whereby platinum ions or ruthenium ions are reduced due to the difference in ionization tendency, and platinum or ruthenium is deposited on the first layer to form the second layer. When a lot of platinum or ruthenium is deposited on the nickel-based first layer, or when the first layer does not contain metal nickel as a main component, but is formed of nickel oxide, cobalt oxide or the like, the cathode substrate having the first layer thereon is immersed in water solution of platinum salt or ruthenium salt, and then subjected to the electrolysis process with the cathode substrate set as a cathode, whereby a second layer of platinum or ruthenium fine particles are electroplated on the first layer. The second layer which is formed according to the method of the present invention is formed on the first layer having a large surface area, so that the second layer also has a large surface area.

Platinum salt used in the present invention is not limited to a specific one. For example, as the platinum salt may be used platinum trichloride, platinum tetrachloride, tetrachloro-platinate, hexachloro platinate, tetrabromo platinate, hexaiodo platinate, bis(oxalate) platinate, chloro-pentaammine platinate, tetrachlorodiammine platinate or the like. Further, Ruthenium salt is not limited to a specific one. For example, as the ruthenium salt may be used ruthenium trichloro trihydrates, ruthenium sulfate, hexachloro ruthenate, pentachloronitrosyl ruthenate, trichlorodiaquanitrosyl ruthenate trihydrates, ruthenate, perruthenate or the like.

The solution of the present invention is prepared by solving the platinum salt or ruthenium salt as described above in suitable solvent such as water, acid, alkali or the like. Usually, water is used as solvent. The concentration of the platinum salt or ruthenium salt in the solution is not fixed to a special value because it varies in accordance with the type of the first layer, the deposition amount of platinum or ruthenium, utilization of the difference in ionization tendency, the second layer forming method such as the electrolysis method or the like, however, usually the concentration is set to $10^{-6}$ mol/liter to 1 mol/liter, preferably to $10^{-5}$ mol/liter to $10^{-1}$ mol/liter. If the concentration of the platinum or ruthenium salt solution is less than $10^{-6}$ mol/liter, it takes an excessively long time to perform a platinum treatment on the first layer and a large amount of water must be used, and thus this condition is not preferable. On the other hand, if the concentration of the platinum or ruthenium salt solution is more than 1 mol/liter, the platinum treatment rate of the first layer is excessively high, and thus it is difficult to form a platinum layer at a desired thickness.

The amount of platinum or ruthenium which is used for the activated cathode of the present invention is not set to a special value because it varies in accordance with the type of the first layer, a target value of the hydrogen overvoltage, the second layer forming method, etc. However, usually, it is set to 1 to 50 g per 1 $m^2$ projected area of the cathode, and preferably to 2 to 20 g. If the amount of platinum or ruthenium in the second layer is less than 1 g per 1 $m^2$ projected area, the reduction of the hydrogen overvoltage may an insufficient effect, and the contamination of the ion-exchange membrane with nickel is insufficiently prevented. Therefore,, this condition is not preferable. On the other hand, if the amount is more than 50 g, the actual effect of the reduction in hydrogen overvoltage does not reach the effect corresponding to the amount.

DETAILED DESCRIPTION OF PREFERRED EMBODIMENTS

The present invention is explained in more detail by reference to the following preferred embodiments. However, the present invention is not intended to be limited to the preferred embodiments.

Embodiments 1 to 4 and Comparative Example 1
(Formation of first layer on metal substrate: Manufacturing cathode substrate)

Expanded metal of nickel (20 mm×20 mm) was degreased with solution of caustic soda, and then washed with water and etched with hydrochloric acid (1+1). After the water washing treatment, an activated cathode which contains Raney nickel as a main component was formed on a nickel substrate under conditions shown in table 1 by a dispersive plating method. The plated nickel substrate having the activated cathode thereon was washed with water, and then immersed in 20% caustic soda solution at 70 to 80° C. for two hours to remove aluminum components, whereby a first layer of Raney nickel was formed on the nickel substrate.

The process as described above was repeated at ten butches to prepare ten cathode substrate samples each having the Raney nickel first layer as described above. The surface roughness of the cathode substrate samples was measured by a double layer capacity method, and the measurement result was 1330 $m^2/m^2$ on average.

TABLE 1

| | PLATING LIQUID | |
|---|---|---|
| | COPONENTS | CONCENTRATION (g/l) |
| COMPOSITION | NICKEL CHLORIDE | 300 |
| | ALUMINIUM CHLORIDE | 50 |
| | BORIC ACID | 38 |
| | Ni-Al ALLOY (50:50) | 0.9 |
| pH VALUE | 2.25–2.30 | |
| TEMPERATURE | 45–50° C. | |
| PLATING CURRENT DENSITY | 3 $A/dm^2$ | |
| PLATING TIME | 90 minutes | |

(Formation of platinum second layer)

Eight samples were picked up from the cathode substrates thus formed, and every two samples of the eight samples were paired (i.e., four pairs of cathode substrates were formed). These paired samples were subjected to an electrolysis process as described below to electrolytically form a platinum (Pt) layer on the first layer of Raney nickel. That is, each pair of cathode substrate samples was immersed in solution of 20% caustic soda while the sample acted as a cathode and a nickel plate acted as an anode, and electrolyzed at a temperature of 20 to 25° C. and a current density of 30 $A/dm^2$ for a treatment time of 20 minutes, thereby forming platinum layers on the cathode substrates of the respective pairs at a thickness of 2, 5, 10 and 20 $g/m^2$. The deposition amount of the platinum layer was adjusted by varying the addition amount of hexachloro platinate to the 20% caustic soda solution.

(Measurement of hydrogen overvoltage)

The hydrogen overvoltage was measured for each activated cathode having the Raney nickel first layer and the platinum second layer formed on the nickel metal substrate as described above by using a current interrupter method. The measurement was performed under the following condition: temperature of 80° C.; NaOH 32%; current density of 30 $A/dm^2$; and reference electrode Hg/HgO (32% NaOH). After the first measurement, each activated cathode was washed with water, and then left under the air at a room temperature for a night (12 hours). Thereafter, the hydrogen overvoltage of each activated cathode was subjected to a second measurement under the same measurement condition. The measurement result is shown in table 2.

Further, the same measurement was performed on one cathode substrate sample having the Raney nickel first layer on the nickel metal substrate which had not been subjected to the electrolysis process, and the measurement of the hydrogen overvoltage of this sample is also shown in the table 2 (Comparative example 1).

TABLE 2

| | Pt LAYER DEPOSITION AMOUNT ($g/m^2$) | FIRST HYDROGEN OVER-VOLTAGE (mv) | SECOND HYDROGEN OVER-VOLTAGE (mv) |
|---|---|---|---|
| EMBODIMENT 1 | 2 | 80 | 82 |
| EMBODIMENT 2 | 5 | 70 | 70 |
| EMBODIMENT 3 | 10 | 60 | 70 |
| EMBODIMENT 4 | 20 | 50 | 50 |
| COMP.EXAMP.1 | 0 | 100 | 185 |

Embodiments 5 to 8 and Comparative Example 2

Ten cathode substrates were formed in the same manner as the embodiment 1. The surface roughness of the cathode substrates thus formed were measured in the same manner. The measurement result was 1370 $m^2/m^2$.

Further, a ruthenium layer was deposited on the first layer of each cathode substrate as described above in the same manner as the embodiments 1 to 4, except that ruthenium soda was used in place of hexachloro platinate. First and second measurements of the hydrogen voltage were performed on each activated cathode having the Raney nickel first layer and the ruthenium second layer on the nickel metal substrate as described above in the same manner as the embodiment 1. The measurement result is shown in table 3.

Further, the same hydrogen overvoltage measurement was performed on a cathode substrate sample (comparative example 2) having only the Raney nickel first layer on the nickel metal substrate which had not been subjected to the electrolysis process, and the measurement result is also shown in the table 3.

TABLE 3

| | Ru LAYER DEPOSITION | FIRST HYDROGEN | SECOND HYDROGEN |
|---|---|---|---|
| EMBODIMENT 5 | 2 | 102 | 105 |
| EMBODIMENT 6 | 5 | 105 | 106 |
| EMBODIMENT 7 | 10 | 107 | 107 |
| EMBODIMENT 8 | 20 | 114 | 115 |
| COMP.EXAMP.2 | 0 | 100 | 190 |

As is apparent from the embodiments and the comparative examples as described above, the activated cathode (embodiments) having the platinum or ruthenium second layer according to the present invention has a lower hydrogen voltage than the conventional activated cathode (comparative examples), and further, when it is washed with water to reuse it, the hydrogen overvoltage of the activated cathode of the present invention does not rise up, whereas that of the conventional activated cathode rises up.

Embodiments 9 to 12 and Comparative Example 3

The hydrogen overvoltage measurement was performed on each of the residual activated cathodes of all the samples formed for the embodiments 1 to 4 in the same manner as the embodiment 1. After the hydrogen overvoltage measurement, each activated cathode was subjected to the normal electrolysis process at a temperature of 80° C., a current density of 50 A/dm$^2$ and a caustic soda concentration of 32% while the activated cathode sample was used as a cathode and a nickel plate was used as an anode. Thereafter, each activated cathode was positively polarized, and then subjected to a backward current test for 9 minutes under the same condition. Thereafter, each activated cathode was subjected to the normal electrolysis process for 120 minutes again, and subjected to the hydrogen overvoltage measurement. The hydrogen overvoltages which were measured before and after the backward current test are shown in table 4. The same hydrogen overvoltage measurement before and after the backward current test was performed on the residual conventional activated cathode (comparative example 3) having only the Raney nickel first layer on the nickel metal substrate of the comparative example 1. The measurement result of the comparative example 3 is also shown in the table 4.

TABLE 4

| | Pt LAYER DEPO-SITION AMOUNT (g/m$^2$) | HYDROGEN OVER-VOLTAGE BEFORE BACKWARD CURRENT TEST (mv) | HYDROGEN OVER-VOLTAGE AFTER BACKWARD CURRENT TEST (mv) |
|---|---|---|---|
| EMBODIMENT 9 | 2 | 82 | 90 |
| EMBODIMENT 10 | 5 | 70 | 74 |
| EMBODIMENT 11 | 10 | 59 | 60 |
| EMBODIMENT 12 | 20 | 50 | 51 |
| COMP.EXAMP.3 | 0 | 100 | 193 |

Embodiments 13 to 16 and Comparative Example 4

The hydrogen overvoltage measurement before and after the backward current test was performed on each of the four residual samples formed for the embodiments 5 to 8 in the same manner as the embodiment 9. The hydrogen overvoltages measured before and after the backward current test are shown in table 5. The same hydrogen overvoltage measurement before and after the backward current test was performed on the residual conventional activated cathode (comparative example 4) having only the Raney first layer on the nickel metal substrate of the comparative example 2. The measurement result is also shown in the table 5.

TABLE 5

| | Pt LAYER DEPO-SITION AMOUNT (g/m$^2$) | HYDROGEN OVER-VOLTAGE BEFORE BACKWARD CURRENT TEST (mv) | HYDROGEN OVER-VOLTAGE AFTER BACKWARD CURRENT TEST (mv) |
|---|---|---|---|
| EMBODIMENT 13 | 2 | 102 | 105 |
| EMBODIMENT 14 | 5 | 105 | 105 |
| EMBODIMENT 15 | 10 | 110 | 105 |
| EMBODIMENT 16 | 20 | 115 | 107 |
| COMP.EXAMP.4 | 0 | 100 | 195 |

Embodiment 17 and Comparative Example 5

Two expanded metals of nickel (100 mm×100 m) each of which was welded to a nickel frame were prepared. Each of these expanded metals was made electrically non-conductive by winding vinyl tape around the frame to thereby form a sample for fabrication of an electrolytic chamber (hereinafter referred to as "electrolytic chamber sample". A Raney nickel layer was formed on the nickel expanded metal portion in the same manner as the embodiment 1. One of the electrolytic chamber sample having the Raney-nickel layer was washed with water, and then it was immersed in mixture solution of 20% caustic soda solution and hexachloro platinate solution without being dried to form a platinum layer on the sample due to the difference of ionization tendency. A platinum concentration analysis showed deposition of 2.0 g/m$^2$ platinum. The residual electrolytic chamber sample was used as a comparative example having only the first layer.

Each of the two samples thus obtained was washed with water, and disposed as a cathode chamber at a lower side of an electrolytic cell without being dried. Further, above the cathode chamber was mounted an anode chamber including a EPDM (ethylene propylene rubber) gasket, an anodic ion-exchange membrane (trade name: Nafion® 962, produced by Dupont) which was treated with 2% sodium bicarbonate solution, a PVDF (polyvinylidene fluoride) gasket, and an electrode (trade name:DSA, produced by Permelec Electrode Ltd.), which were welded to a titanium frame, thereby fabricating each electrolytic cell. The electrolytic cell thus fabricated was left for 7 days while sealed. Thereafter, the electrolysis process was performed in each electrolytic cell for three days on the following condition: temperature of 80° C., current density of 50 A/dm$^2$, a caustic soda concentration of 32%, and weak salt water concentration of 200 g/liter. Thereafter, each electrolytic cell was dismantled, and the ion-exchange membrane was observed. The result was that the ion-exchange membrane using the cathode chamber with no platinum layer (comparative example 5) was colored black in the same shape as the expanded metal, however, the ion-exchange membrane using the cathode chamber with the platinum layer was never colored black.

Embodiment 18

A sample having a ruthenium second layer formed on a Raney nickel first layer was formed in the same manner as the embodiment 17 except that soda ruthenate solution was used in place of hexachloro platinate solution, and 20% caustic soda and soda ruthenate solution were mixed with each other to prepare mixture solution. Further, an electrolytic cell was fabricated in the same manner as the embodiment 17 except that the electrolytic chamber sample having the ruthenium second layer was used as a cathode. Thereafter, the electrolysis process was performed on the electrolytic cell in the same manner as described above, and then the electrolytic cell was dismantled to observe the ion-exchange membrane at the cathode side. The observation result was that the ion-exchange membrane was not contaminated.

Embodiments 19 to 24 and Comparative Example 6

A nickel expanded metal (100 mm×100 mm) was degreased with trichelene, then subjected to a blasting treatment with alumina, and then subjected to the same process as an embodiment 1 disclosed in Japanese Post-Examined Patent Application No. Hei-3-44154 to prepare an active layer of nickel oxide. The surface roughness of the nickel oxide layer was measured by a double layer capacitance method, and the measurement result was 1210 m$^2$/m$^2$ on average.

The expanded metal having the nickel oxide layer thus formed was welded to the nickel frame to form a cathode chamber. Thereafter, a platinum or ruthenium layer was formed on the nickel oxide layer of each of the two cathode chambers thus formed in the same manner as the embodiments 1 to 3 and the embodiments 5 to 7. A mono-poly type compact electrolytic cell (interpolar distance of 2 mm) was fabricated by each cathode chamber. Further, Nafion® 962 was used as an ion-exchange membrane, and the electrolysis process was performed for 30 days under the following condition: temperature of 90° C.; current density of 30 A/dm$^2$; caustic soda concentration of 32%; and weak salt water concentration of 200 g/liter. An electrolytic voltage of each mono-pole type compact electrolytic cell was measured, and the measurement result is shown in table 6.

Further, the electrolysis estimation was also performed on a cathode chamber having only the nickel oxide layer on the nickel substrate (comparative example 6), and its measurement result is also shown in table 6.

TABLE 6

| | | DEPOSITION AMOUNT (g/m$^2$) | ELECTROLYTIC VOLTAGE (V) |
|---|---|---|---|
| EMBODIMENT 19 | Pt LAYER | 2 | 2.90 |
| EMBODIMENT 20 | | 5 | 2.89 |
| EMBODIMENT 21 | | 10 | 2.88 |
| EMBODIMENT 22 | Ru LAYER | 2 | 2.94 |
| EMBODIMENT 23 | | 5 | 2.93 |
| EMBODIMENT 24 | | 10 | 2.92 |
| COMPARATIVE EXAMPLE 6 | | NO | 2.95 |

From the embodiments and the comparative examples as described above, it is apparent that the activated cathode having the platinum layer or ruthenium layer (second layer) on the nickel oxide layer (first layer) on the substrate according to the present invention has a slightly lower electrolytic voltage than the activated cathode having only the nickel oxide layer (first layer) on the metal substrate. Further, as the deposition amount of platinum or ruthenium increases, the electrolytic voltage drops down to a smaller value.

Embodiments 25 to 30 and Comparative Example 7

A nickel expanded metal (100 mm×100 mm) was degreased with trichelene, then subjected to a blasting treatment with alumina, and then subjected to the same process as an embodiment 1 disclosed in Japanese Post-Examined Patent Application No. Hei-3-44154 to prepare an active layer of cobalt oxide. The surface roughness of the cobalt oxide layer was measured by a double layer capacitance method, and the measurement result was 1070 m$^2$/m$^2$ on average.

The expanded metal having the cobalt oxide layer thus formed was welded to the nickel frame to form a cathode chamber. Thereafter, a platinum or ruthenium layer was formed on the cobalt oxide layer of each of the two cathode chambers thus formed in the same manner as the embodiments 1 to 3 and the embodiments 5 to 7. A mono-poly type compact electrolytic cell (interpolar distance of 2 mm) was fabricated by each cathode chamber. The electrolysis process was performed in the mono-poly type electrolytic cell in the same manner as the embodiments 19 to 24. An electrolytic voltage of each mono-pole type compact electrolytic cell was measured, and the measurement result is shown in table 7.

Further, the electrolysis estimation was also performed on a cathode chamber having only the cobalt oxide layer on the nickel substrate (comparative example 7), and its measurement result is also shown in table 7.

TABLE 7

| | | DEPOSITION AMOUNT (g/m$^2$) | ELECTROLYTIC VOLTAGE (V) |
|---|---|---|---|
| EMBODIMENT 25 | Pt LAYER | 2 | 2.99 |
| EMBODIMENT 26 | | 5 | 2.97 |
| EMBODIMENT 27 | | 10 | 2.95 |
| EMBODIMENT 28 | Ru LAYER | 2 | 3.01 |
| EMBODIMENT 29 | | 5 | 2.99 |
| EMBODIMENT 30 | | 10 | 2.97 |
| COMPARATIVE EXAMPLE 7 | | NO | 3.03 |

From the embodiments 25–30 and the comparative example 7 as described above, it is apparent that the activated cathode having the platinum layer or ruthenium layer (second layer) on the cobalt oxide layer (first layer) on the substrate according to the present invention has a lower electrolytic voltage than the activated cathode having only the cobalt oxide layer (first layer) on the metal substrate. Further, as the deposition amount of platinum or ruthenium increases, the electrolytic voltage drops down to a smaller value.

Comparative Examples 8 and 9

The nickel expanded metal used in the embodiment 1 was degreased with caustic soda solution, washed with water and then etched with hydrochloric acid in the same manner as the embodiment 1. After the water-washing, the surface roughness of the treated expanded metal was measured by the double layer capacitance method, and the measurement result was 13 m$^2$/m$^2$ on average. The electrolysis process was performed on the surface of the treated expanded metal as described above in the same manner as the embodiments 3 and 3 and the embodiments 7 and 8 to prepare two expanded metals on which platinum were electroplated at an amount of 10 g/m$^2$ and at an amount of 20 g/m$^2$ respectively, and two expanded metals on which ruthenium were electroplated at an amount of 10 g/m$^2$ and at an amount of 20 g/m$^2$.

A mono-polar type compact electrolytic cell was fabricated by using as a cathode each of the nickel expanded metals having the platinum or ruthenium layer on the nickel substrate, and the electrolysis processing as described above was performed. The hydrogen overvoltage in the electrolytic process was equal to 150 mV and 120 mV for the platinum deposition amounts of 10 g/m$^2$ and 20 g/m$^2$ respectively, and 250 mV and 220 mV for the ruthenium deposition amounts of 10 g/m$^2$ and 20 g/m$^2$ respectively. Further, as a result of observation of the cathodes after the electrolytic process, it was observed that platinum (ruthenium) was partially exfoliated, and the nickel substrate was exposed.

As described above, according to the present invention, a chemically stable platinum or ruthenium layer is formed on the surface of a conventional active cathode comprising a metal substrate and a nickel-based or cobalt-based coating on the metal substrate so that the platinum or ruthenium layer has a large cathode working surface area. Therefore, the hydrogen overvoltage can be reduced, and the activity can be kept stable. Further, the contamination of the ion-exchange membrane with nickel can be prevented, and even when an electrolytic process is stopped or an electrolytic cell is dismantled, the activated cathode can be prevented from being deteriorated due to the backward current or oxidation in the air. Still further, the hydrogen overvoltage can be also reduced for the conventional activated cathode having a nickel oxide or cobalt oxide coating which is formed by the thermal spraying method, and thus the activated cathode of the present invention can be easily manufactured by using the conventional activated cathode.

What is claimed is:

1. An activated cathode having a cathode working area 30 to 3000 times a 1 $m^2$ projection area of the cathode comprising:

a metal substrate;

a first layer which contains nickel or cobalt as a main component, and is formed on said metal substrate; and a second layer which consists of elemental platinum or elemental ruthenium, and which is formed on said first layer, provided that where said first layer contains cobalt as the main component, said second layer consists of platinum.

2. The activated cathode as claimed in claim 1, wherein said first layer is formed of Raney nickel.

3. The activated cathode as claimed in claim 1, wherein said first layer is formed of nickel oxide or cobalt oxide, and said second layer is formed of fine platinum or ruthenium particles.

4. The activated cathode as claimed in claim 3, wherein said platinum or ruthenium particles have a grain size of 0.001 to 0.001 $\mu$m.

* * * * *

UNITED STATES PATENT AND TRADEMARK OFFICE

CERTIFICATE OF CORRECTION

PATENT NO. : 5,954,928
DATED : September 21, 1999
INVENTOR(S) : Kishi et al.

It is certified that error appears in the above-identified patent and that said Letters Patent is hereby corrected as shown below:

Claim 4,
Line 3, "0.001 to 0.001" should read as -- 0.001 to 0.01 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*